US011759088B2

(12) United States Patent
Tütek

(10) Patent No.: US 11,759,088 B2
(45) Date of Patent: Sep. 19, 2023

(54) SOFT START-STOP RACK ADJUSTMENT MECHANISM

(71) Applicant: SERDAR PLASTİK SANAYI VE TİCARET ANONİM ŞİRKETİ, Ankara (TR)

(72) Inventor: Serdar Tütek, Ankara (TR)

(73) Assignee: SERDAR PLASTIK SANAYI VE TICARET ANONIM SIRKETI, Ankara (TR)

( * ) Notice: Subject to any disclaimer, the term of this patent is extended or adjusted under 35 U.S.C. 154(b) by 0 days.

(21) Appl. No.: 17/605,588

(22) PCT Filed: Apr. 21, 2020

(86) PCT No.: PCT/TR2020/050335
§ 371 (c)(1),
(2) Date: Oct. 22, 2021

(87) PCT Pub. No.: WO2020/218995
PCT Pub. Date: Oct. 29, 2020

(65) Prior Publication Data

US 2022/0202271 A1 Jun. 30, 2022

(30) Foreign Application Priority Data

Apr. 24, 2019 (TR) ..... 2019/06070

(51) Int. Cl.
*A47L 15/50* (2006.01)

(52) U.S. Cl.
CPC ..... *A47L 15/504* (2013.01)

(58) Field of Classification Search
CPC ..... A47L 15/507; A47L 15/50; A47L 15/504; A47L 15/506; A47B 2088/401
See application file for complete search history.

(56) References Cited

U.S. PATENT DOCUMENTS 5,474,378 A * 12/1995 Smith ..... A47L 15/507 D15/19
5,860,716 A * 1/1999 Good ..... A47L 15/504 312/351
6,974,040 B2 * 12/2005 Jahrling ..... A47L 15/504 211/175
7,168,578 B2 * 1/2007 Mersch ..... A47L 15/504 211/41.9
7,410,228 B2 * 8/2008 Dickson ..... A47L 15/504 312/351
7,418,967 B2 * 9/2008 Kim ..... A47L 15/504 312/351

(Continued)

*Primary Examiner* — Patrick D Hawn

(57) ABSTRACT

In general terms, the present invention relates to a soft transition rack adjustment mechanism that is designed to be used in dishwashers with one or a multitude of superimposed products receiving racks and that comprises a secure, three-stage movement system that protects the items therein. The present invention relates to both performing transitions between stages and ensuring that these transitions are made in a soft and controlled manner by means of an infinite-life, stainless plastic spring that is positioned inside the inventive rack adjustment mechanism, and that does not require any additional components, nor creates any additional costs.

13 Claims, 5 Drawing Sheets

(56) References Cited

U.S. PATENT DOCUMENTS

| | | | | |
|---|---|---|---|---|
| 7,424,893 | B2 * | 9/2008 | Kim | A47L 15/504 312/351 |
| 7,651,180 | B2 * | 1/2010 | Deiss | A47L 15/504 312/351 |
| 7,775,378 | B2 * | 8/2010 | Tynes | A47L 15/504 211/41.8 |
| 8,192,557 | B2 * | 6/2012 | Ryu | A47L 15/504 134/147 |
| 8,534,471 | B2 * | 9/2013 | Wong | A47L 15/504 312/351 |
| 8,567,882 | B1 * | 10/2013 | Garnett | A47L 15/504 312/351 |
| 9,004,082 | B2 * | 4/2015 | Bhajak | A47L 15/504 134/135 |
| 9,579,009 | B2 * | 2/2017 | Bhajak | A47L 15/504 |
| 9,763,557 | B2 * | 9/2017 | Kim | A47L 15/507 |
| 10,022,037 | B2 * | 7/2018 | Kutto | A47L 15/502 |
| 10,034,596 | B2 * | 7/2018 | Bennett | A47L 15/4293 |
| 10,136,795 | B2 * | 11/2018 | Nowell, Jr. | A47L 15/507 |
| 10,383,506 | B2 * | 8/2019 | Minniti | A47L 15/504 |
| 10,582,829 | B2 * | 3/2020 | Hansen | A47L 15/4293 |
| 10,602,909 | B2 * | 3/2020 | Gupta | A47L 15/507 |
| 10,820,783 | B2 * | 11/2020 | Lam | A47L 15/507 |
| 10,869,562 | B1 * | 12/2020 | Bryan | A47B 57/583 |
| 11,369,250 | B2 * | 6/2022 | Lam | F16B 2/14 |
| 11,445,887 | B2 * | 9/2022 | Singhal | A47L 15/507 |

* cited by examiner

SOFT START-STOP RACK ADJUSTMENT MECHANISM

The present invention relates to a rack adjustment mechanism that is designed to be used in dishwasher racks on which one or more superimposed dishes are loaded, and that is capable of performing a soft start and stop movement once the rack level adjustment is made when the dishwasher rack is loaded with dishes without integrating an additional shock absorber to the system. The inventive soft movement mechanism, in addition to preventing the dishes located inside the dishwasher rack from getting damaged, keeps the user of the dishwasher from sustaining any potential injuries. The soft start-stop system becomes activated once movement latch of the rack adjustment mechanism gets triggered, thereby enabling the movement of the rack. The dishwasher rack will not move as long as the aforementioned latch does not get triggered and will not damage the dishes. Rack adjustment mechanisms located at the side portions of the upper rack of dishwashers make height adjustment by moving the rack of the dishwasher in the upward or downward directions once the movement latch gets triggered, thereby making room based on the sizes of dishes in the downward or upward directions inside the dishwasher for the dishes to be placed onto the dishwasher rack.

TECHNICAL FIELD OF THE INVENTION

In general terms, the present invention relates to washing racks used in dishwashers and suchlike machines in which racks are utilized and particularly to dishwasher racks and lower and upper rack placement movements thereof. Conventional dishwashers comprise a front cover and racks mounted on the tub of the dishwasher. In cases where items to be placed into the dishwasher have different sizes, the space within the dishwasher may be used in the most efficient manner by moving the rack in upward and downward directions by means of the inventive rack adjustment mechanisms located at the sides of the upper rack.

STATE OF THE ART

In the state of the art, rack movements are performed by supporting a rack with another rack located right below. The upper or the supported rack is pulled outside of the washing chamber by means of pulling the lower or the support rack out of the washing chamber. In order to load the lower rack, the upper rack is lifted over the lower rack and dishes are placed onto the lower rack, subsequently, the upper or the supported rack is moved to the support position on the lower rack. This technique poses a disadvantage, as well as an inconvenience for the user. When the user desires to load the dishwasher completely with soiled dishes and kitchenware, both racks must be pulled out of the washing chamber, the upper rack must be removed from the supports and both racks should be filled. In order to ensure that the upper rack gets seated accurately and properly, it must be moved back to its location on the lower rack. This imposes physical difficulties for the user when placing loaded racks back into the washing chamber.

Conventional dishwashers comprise a front cover and racks mounted on the washing chamber the dishwasher. In cases where dishes and kitchenware to be placed onto the dishwasher racks have different sizes, the space within the dishwasher may be used in the most efficient manner by moving the rack in the upward and downward directions by means of the rack adjustment mechanisms located at the sides of the rack. However, when this movement is not supported by the mechanism, it may impose a physical difficulty for the user, and may also damage the items inside the dishwasher. Sliding dishrack wheel assembly may damage the items located inside the dishwasher or may harm the user when the rack is moved in the upward or downward directions in order to make room for items. This creates a loss in the sense of trust while using the rack mechanism.

BRIEF DESCRIPTION OF THE INVENTION

In general terms, the present invention relates to a soft transition rack adjustment mechanism that is designed to be used in dishwashers with one or a multitude of superimposed product receiving racks and that comprises a secure, three-stage movement system that protects the items therein. The present invention relates to both performing transitions between stages and ensuring that these transitions are made in a soft and controlled manner by means of an infinite-life, stainless plastic spring that is positioned inside the inventive rack adjustment mechanism, and that does not require any additional components, nor creates any additional costs.

DETAILED DESCRIPTION OF THE INVENTION

The present invention relates to a soft start-stop rack adjustment mechanism that is manufactured from plastic material, that is resistant to high and low temperatures, chemicals and pressure, that features a stainless and light body and that is capable of moving both loaded and load-free.

In general terms, the present invention relates to a softly moving rack adjustment mechanism that is designed to be used in dishwashers with one or a multitude of superimposed product receiving racks that comprise a secure, three-stage movement system that protects the items therein. The upper rack is mounted so as to ensure that it is capable of going in and out of the conventional washing chamber. When the entirety of the upper rack is inside the washing chamber, it is supported by the tub independently of the lower rack. When the upper rack comes out of the washing chamber, it is partially supported by the carriers located on the tub. When the lower rack enters the washing chamber, it is supported from the sides by the tub. When the lower rack is out of the washing chamber, it is partially supported by the cover.

The present invention is characterized by a soft rack adjustment mechanism that is manufactured from plastic material, that is resistant to high and low temperatures, chemicals and pressure, that features a stainless and light body and that is capable of moving both loaded and load-free.

REFERENCE NUMERALS

Figure 1:
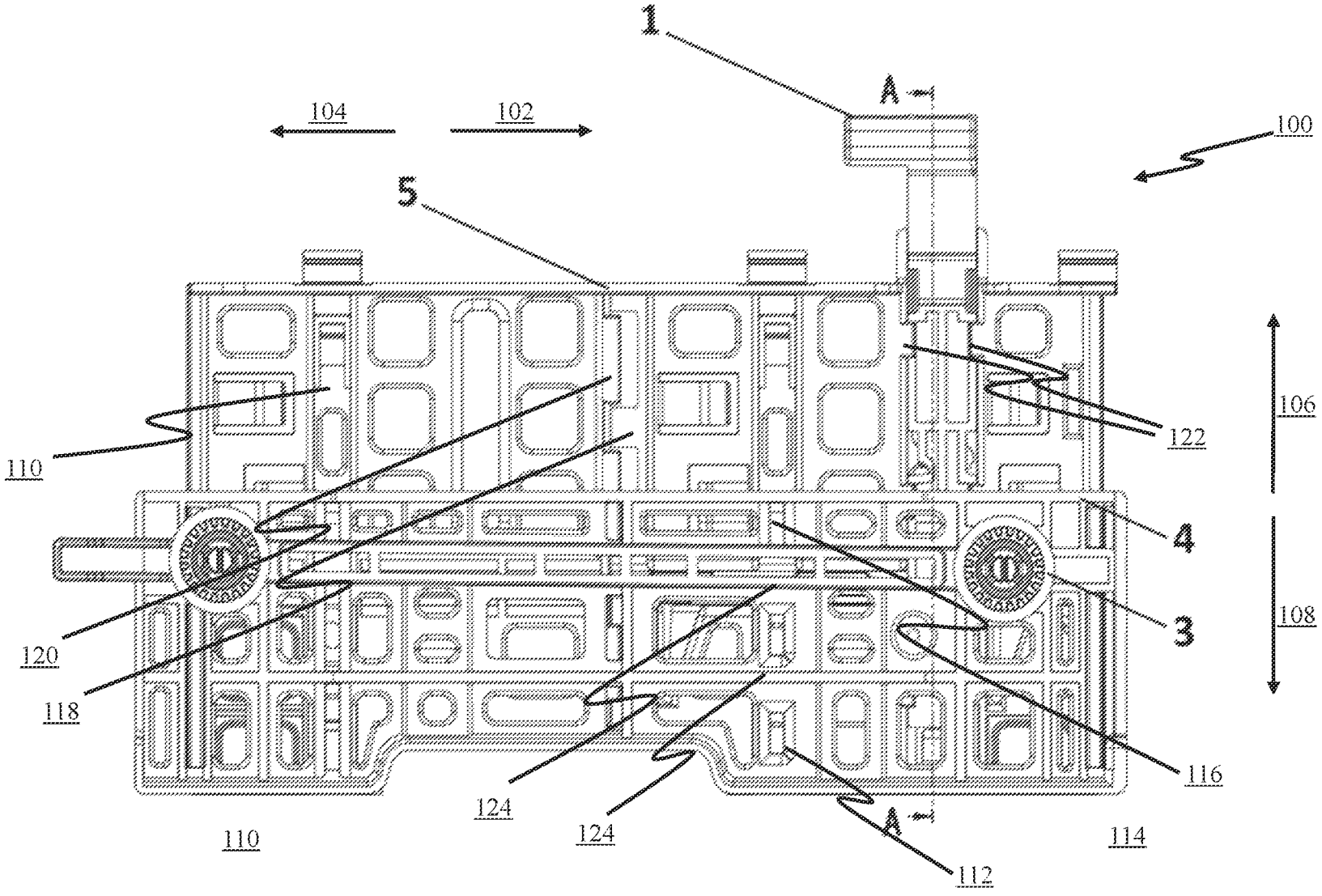
FIG. 1 illustrates the front view of the inventive soft rack adjustment mechanism.
Figure 2:
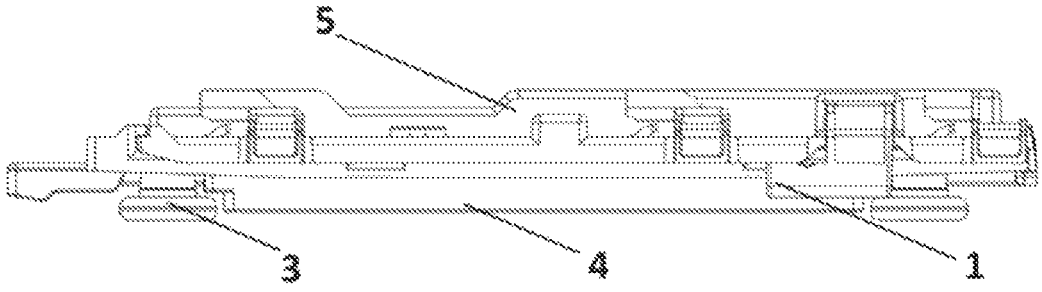
FIG. 2 illustrates the top view of the inventive soft rack adjustment mechanism.

1 Latch
2 Lock
3 Roller Wheel
4 Rack Main Body
5 Mechanism Main Body
6 At least two springs
100—start-stop rack adjustment mechanism; 102—first direction; 104—second direction; 106—third direction; 108—fourth direction; 110—second longitudinal slot; 112—first support member; 114—second support member; 116—third support member; 118—third longitudinal slot; 120—first lateral protrusion; 122—pair of first lateral protruding members; 124—space between supporting members; 302—first guiding member; 304—second lateral protrusion; 702—first longitudinal slot; 704—first lateral slot; 706—first locking member; 708—second locking member; 710—third locking member; 712—first angled surface; 714—second angled surface; 716—third angled surface; 718—pair of V-shaped space; 720—space between locking members.

In cases where more space is needed due to the sizes of items placed into the dishwasher, latch (1) located at the sides of the dishwashing rack sets the mechanism in motion and softly moves in the upward and downward directions without damaging the items in order to facilitate loading kitchenware onto the upper rack and to diversify based on dimensions. The rack main body (4) which is capable of performing reciprocating motion through the roller wheels (3) thereof allows for receiving items from the dishwashing rack in a safe manner by being opened in a three-stage arrangement and in a soft and controlled way by means of the inventive mechanism.

Unlike similar technologies, the inventive mechanism comprises a three-stage transition system. The inventive mechanism features three stages as up, middle and down based on the dimensions of dishes placed into the dishwasher. Providing not only up and down stages but also the middle stage allows for ensuring both another dishwashing rack function and dimension diversity for the dishes to be placed into the dishwasher. The fact that the inventive mechanism features three stages allows for positioning the dishwashing rack in a controlled manner, thereby keeping the dishes placed thereon from being subjected to any type of hard impact from top to bottom or from bottom to top.

The at least two springs (6) which does not create any need towards additional parts, nor any additional cost enables soft transition between the stages. Being one of the complementary components of the soft movement of the dishwashing rack adjustment mechanism, the spring at least two springs (6) mechanism brings forth an additional advantage since it eliminates any condition involving being neglected during the assembly process.

The at least two springs (6) system creates no additional costs since it does not require any metal springs.

In cases where more space is needed due to the dimensions of items placed into the dishwasher for being washed, the latch (1) located at the sides of the upper dishwashing rack sets the mechanism in motion and softly moves in the upward, downward and central directions without damaging the items within the dishwasher. Having roller wheels (3) for performing the reciprocating motion, the mechanism allows for receiving items from the dishwashing rack in a safe manner by being opened in a three-stage arrangement and a soft manner.

The lock (2) system is the mechanism that enables the upper rack to maintain its position reached subsequent to its movement.

The lock (2) system becomes activated by means of the latch (1) located on the mechanism main body (5). The latch (1) ensures that the mechanism is fixed in the respective stage when the dishwasher rack is moved to up, middle or down positions. The latch (1) locks the dishwasher rack in its current position by ensuring that the mechanism main body (5) remains in the upper stage when the dishwasher rack is in the upward position, in the middle stage when the dishwasher rack is in the middle position and the lower stage when the dishwasher rack is in the downward position.

The inventive soft start-stop mechanism (100) becomes activated once the rack adjustment movement latch (1) is triggered, thereby allowing the dishwasher rack to move in desired three different stages. The dishwasher rack does not move thanks to the lock (2) mechanism as long as the latch (1) does not get triggered and remains in the stage to which it was brought to, thereby being prevented from damaging the dishes.

The mechanism main body (5) having a mechanism without hitting other racks, washing chamber and the tub. It is characterized by being a safe mechanism that does not move unless the user presses the latch (1), thereby protecting the dishes, and that ensures a soft placement when it reaches to the point in which it shall be seated by means of the three-stage transition mechanism once it is moved by slowing down without causing any damage to dishes nor harming the user.

Figure 3:
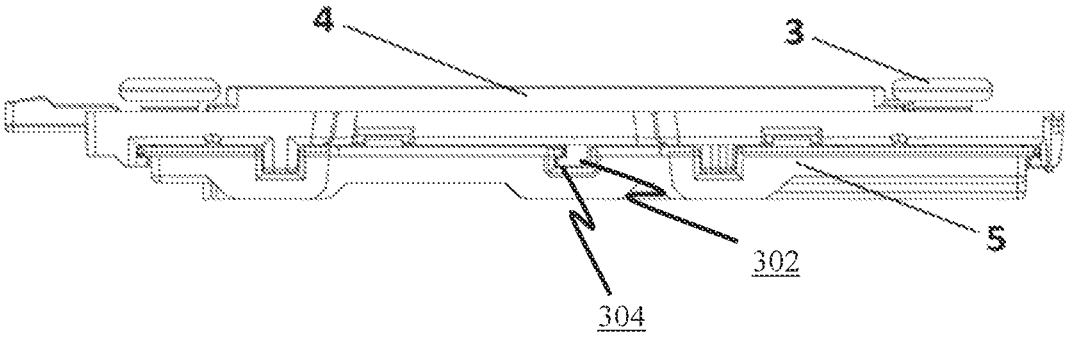
FIG. 3 illustrates the bottom view of the inventive soft rack adjustment mechanism.
Figure 5:
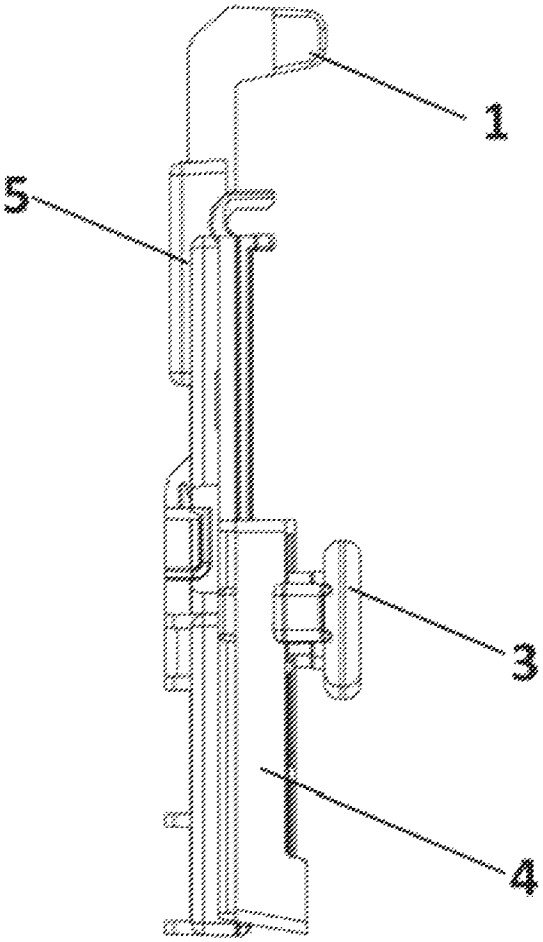
FIG. 5 illustrates the inventive soft rack adjustment mechanism from the right side.
Figure 4:
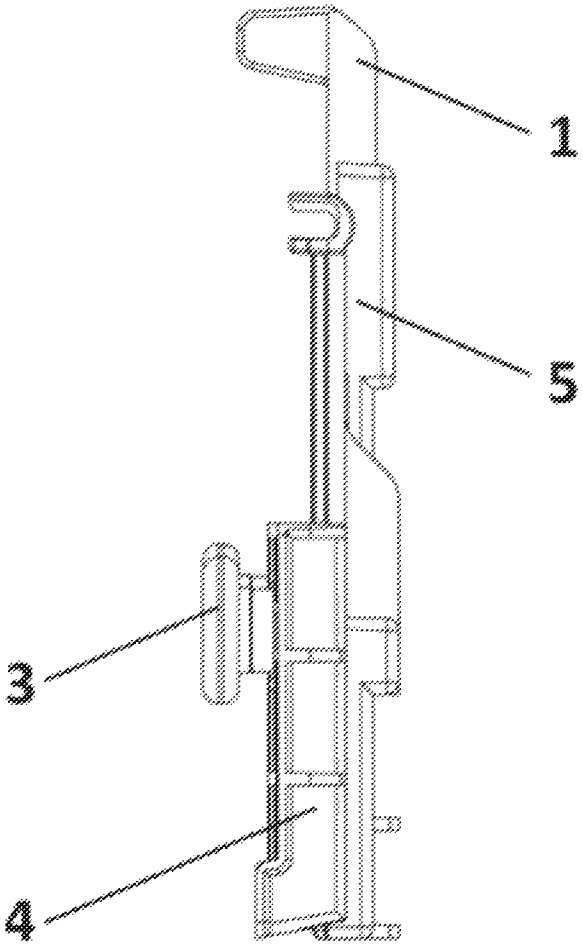
FIG. 4 illustrates the inventive soft rack adjustment mechanism from the left side.
Figure 6:
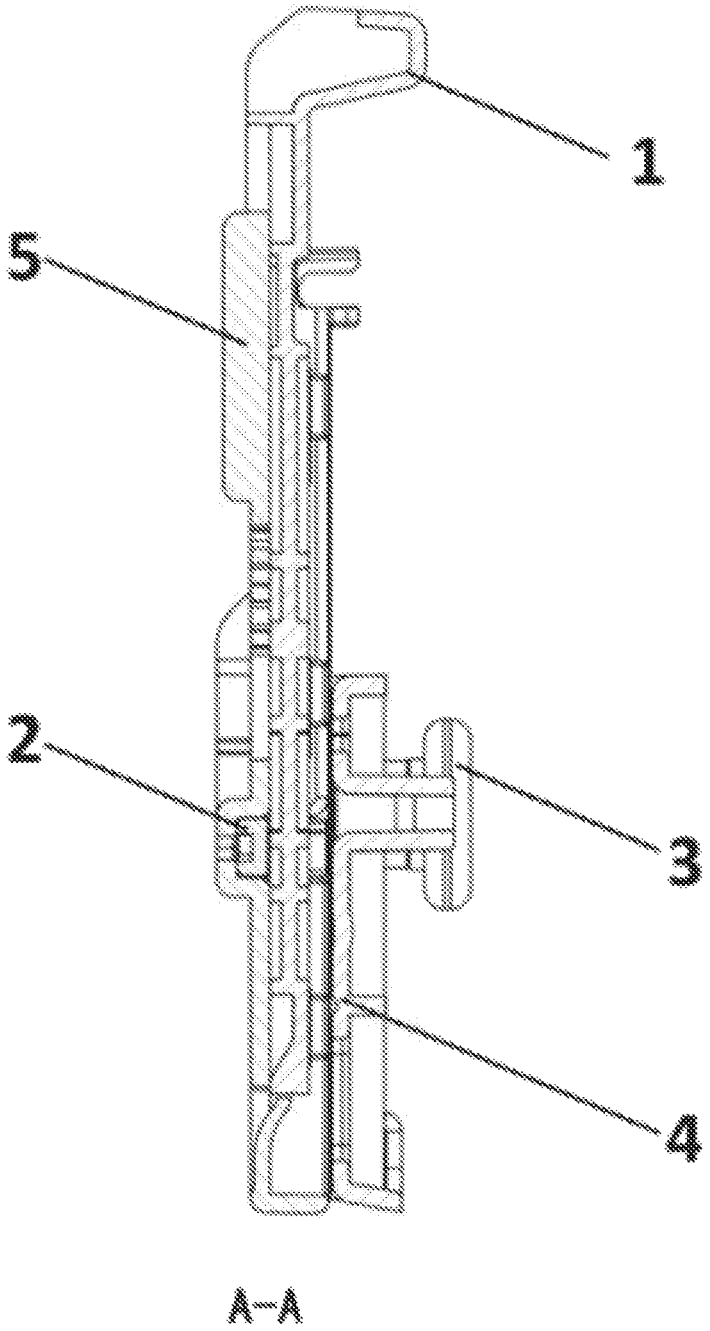
FIG. 6 illustrates the sectional view of the inventive soft rack adjustment mechanism.
Figure 7:
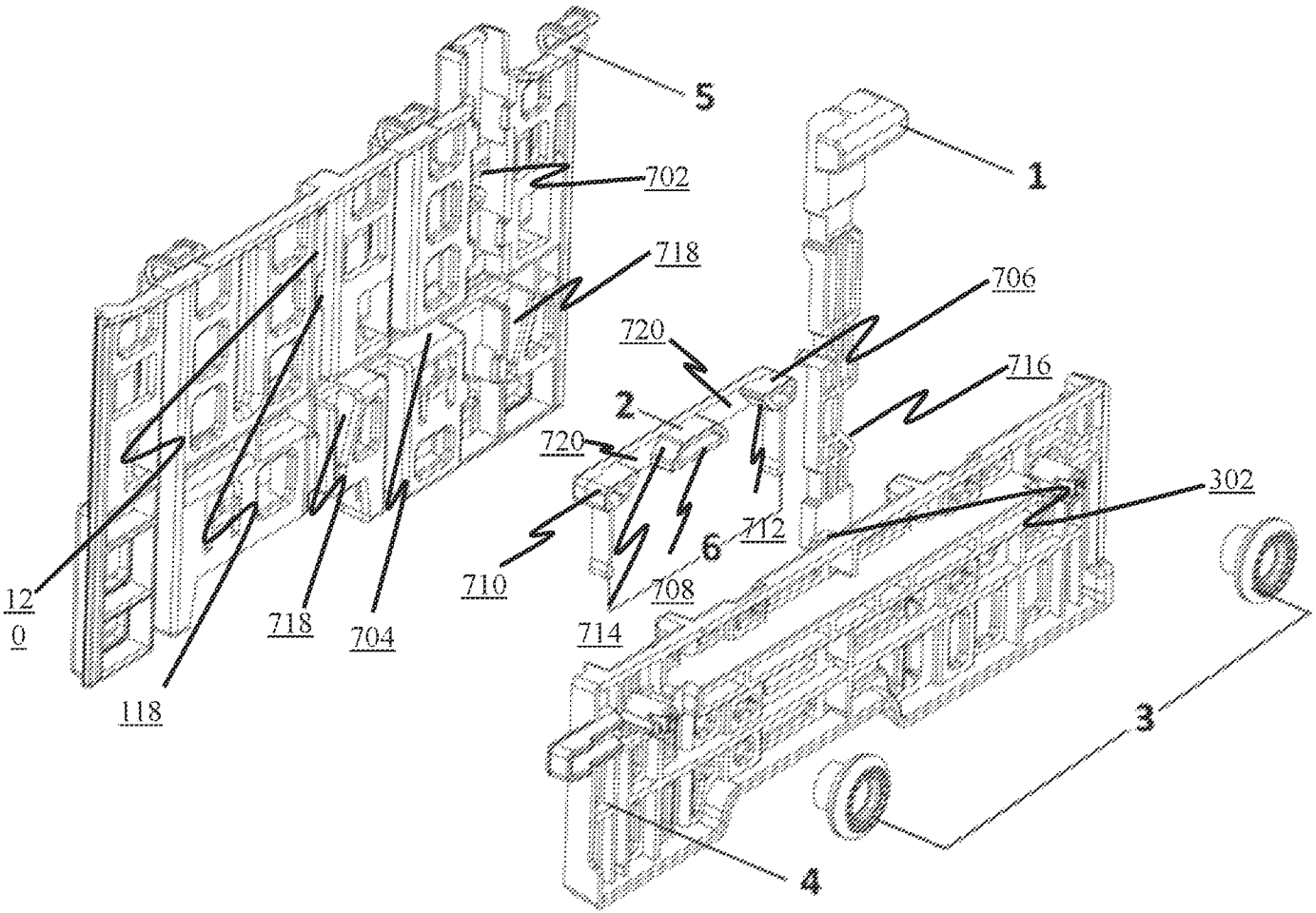
FIG. 7 illustrates the isometric view of the inventive soft rack adjustment mechanism.

Referring to FIGS. 1, 3, and 7, according to an embodiment, a start-stop rack adjustment mechanism (100) for a dishwasher rack may comprise of the mechanism main body (5), the latch (1), the lock (2), and the rack main body (4).

In an embodiment, the mechanism main body (5) may define a first longitudinal slot (702), at least one second longitudinal slot (110), and a first lateral slot (704).

In an embodiment, the latch (1) may be disposed on the mechanism main body (5), wherein the latch (1) may be configured to be received within the first longitudinal slot (702).

In an embodiment, the lock (2) may be received by the first lateral slot (704). Further, the lock (2) may be configured to move laterally in a first direction (102) and a second direction (104) within the first lateral slot (704) when the latch (1) interfaces with at least a portion of the lock (2). The lock (2) may be configured to move only in the first direction or the second direction at a time.

In an embodiment, the lock (2) comprises at least two springs (6). The at least two springs (6) may be disposed below the lock (2). At least a portion of the springs (6) may be received by the mechanism main body (5).

In an embodiment, the rack main body (4) may be disposed on a side wall of a dishwasher.

In an embodiment, at least a portion of the rack main body (4) may be configured to be received by the at least one second longitudinal slot (110).

In an embodiment, the latch (1) may be disposed between the mechanism main body (5) and the rack main body (4).

In an embodiment, the lock (2) may be configured to move perpendicular to movement of the mechanism main body (5).

In an embodiment, the mechanism main body (5) may be configured to longitudinally transition between an upper position, a middle position, and a lower position.

In an embodiment, the rack main body (4) may comprise of plurality of support members (112, 114, 116). The plurality of support members (112, 114, 116) are protrusions, wherein a space (124) may be defined between each of the support members (112, 114, 116) and the adjacent support member (112, 114, 116).

In an embodiment, the space (124) between the plurality of support members (112, 114, 116) may be configured to receive at least a portion of the lock (2) and may enable lateral movement of the lock (2).

In an embodiment, the plurality of support members (112, 114, 116) may be longitudinally aligned. At least a portion of the plurality of support members (112, 114, 116) may be received by the second longitudinal slot (110). The plurality of support members (112, 114, 116) may be configured to traverse longitudinally within the second longitudinal slot (110).

In an embodiment, the plurality of support members (112, 114, 116) may comprise of a first support member (112), a second support member (114) and a third support member (116). The second support member (114) may be disposed between the first support member (112) and the third support member (116).

In an embodiment, in the upper position, the lock (2) may be positioned between the first support member (112) and the second support member (114);

In an embodiment, in the middle position, the lock (2) may be positioned between the second support member (114) and the third support member (116).

In an embodiment, in the lower position, the lock (2) may be positioned below the third support member (116).

In an embodiment, the lock (2) may comprise of a first locking member (706), a second locking member (708) and a third locking member (710), wherein each of the locking members (706, 708, 710) and the adjacent locking member (706, 708, 710) may define a space (720). Further, the second locking member (708) may be disposed between the first locking member (706) and the third locking member (710).

In an embodiment, the springs (6) may be connected to the first locking member (706) and the third locking member (710) respectively.

In an embodiment, the locking members (706, 708, 710) protrude from the lock (2) towards the rack main body (4).

In an embodiment, the first locking member (706) may comprise a first angled surface (712). The second locking member (708) may comprise a second angled surface (714). Further, the first angled surface (712) of the first locking member (706) may be opposite to the second angled surface (714) of the second locking member (708).

In an embodiment, the latch (1) may comprise a third angled surface (716). The first angled surface (712) may be parallel to the third angled surface (716) of the latch (1). When the latch (1) is moved longitudinally in a third direction (106), the first angled surface (712) of the first locking member (706) may be configured to interface with the third angled surface (716) of the latch (1). Further, the lock (2) may be configured to move laterally in the first direction (102) when the first angled surface (712) of the first locking member (706) interfaces with the third angled surface (716) of the latch (1).

In an embodiment, when at least one support member (112, 114, 116) is moved longitudinally in a fourth direction (108), at least a portion of at least one surface of the support member (112, 114, 116) may interface with at least a portion of the second angled surface (714) of the second locking member (708). Further, the lock (2) may be configured to move laterally in the first direction (102) and may enable the at least one support member (112, 114, 116) to pass through the space (720) defined between the second locking member (708) and the third locking member (710).

In an embodiment, the mechanism main body (5) may define a third longitudinal slot (118), wherein at least one first lateral protrusion (120) may be provided towards an opening of the third longitudinal slot (118), wherein the first lateral protrusion (120) may overlap at least a portion of the third longitudinal slot (118).

In an embodiment, the rack main body (4) may comprise of a first guiding member (302) provided with a second lateral protrusion (304). The second lateral protrusion (304) may be configured to interface with the first lateral protrusion (120) when the first guiding member (302) is received within the third longitudinal slot (118).

In an embodiment, the first guiding member (302) may be configured to traverse longitudinally within the third longitudinal slot (118).

In an embodiment, the first longitudinal slot (702) may be provided with at least a pair of first lateral protruding members (122) provided towards an opening of the first longitudinal slot (702).

In an embodiment, the pair of first lateral protruding members (122) may overlap at least a portion of the first longitudinal slot (702).

In an embodiment, the pair of first lateral protruding members (122) may limit movement of the latch (1) to longitudinal direction (106, 108) when the latch (1) is received by the first longitudinal slot (702).

In an embodiment, the mechanism main body (5) may define a pair of V-shaped spaces (718) disposed below the first lateral slot (704).

In an embodiment, at least a portion of the springs (6) may be received by the pair of V-shaped spaces (718) when the lock (2) is received by the first lateral slot (704).

In an embodiment, each of the pair of V-shaped spaces (718) may be configured to allow lateral movement (102, 104) of the springs (6) thereby enabling lateral movement (102, 104) of the lock (2) within the first lateral slot (704).

In an embodiment, the at least two springs (6) may be made of a plastic material.

In an embodiment, the at least two springs (6) may be made of a rust free material.

In an embodiment, the start-stop rack adjustment mechanism (100) may be installed in a dishwasher. The roller wheels (3) disposed on the rack main body (4) may interface with a rail installed on a sidewall of the dishwasher. The start-stop rack adjustment mechanism (100) may be configured to traverse in a front direction and a back direction i.e., IN and OUT of the dishwasher. Further, the start-stop rack adjustment mechanism (100) may be configured to longitudinally transition between the upper position, the middle position, and the lower position.

In the same embodiment, to transition from the upper position to the middle position, the latch (1) may be activated by a user. The latch (1) may be activated by applying a pull force on one end of the latch (1) towards the third direction (106). Pulling of the latch (1) may enable the interfacing of the first angled surface (712) of the first locking member (706) with the third angled surface (716) of the latch (1). Thereby, lock (2) may be configured to move laterally in the first direction (102).

When the first locking member (706) moves in the first direction (102), the second locking member (708) may also move in the first direction (102), thereby, allowing the second support member (114) to pass beyond the lock (2) inside the second longitudinal slot (110).

In the same embodiment, to transition from the middle position to the lower position, the latch (1) may be activated by the user. The latch (1) may be activated by applying a pull force on one end of the latch (1) towards the third direction (106). Pulling of the latch (1) may enable the interfacing of the first angled surface (712) of the first locking member (706) with the third angled surface (716) of the latch (1). Thereby, lock (2) may be configured to move laterally in the first direction (102).

When the first locking member (706) moves in the first direction (102), the second locking member (708) may also move in the first direction (102), thereby, allowing the first support member (112) to pass beyond the lock (2) inside the second longitudinal slot (110).

In the same embodiment, to transition from the lower position to the middle position, when the user pulls the dishwasher rack towards the third direction (106), at least a portion of at least one surface of the first support member (112) may interface with at least a portion of the second angled surface (714) of the second locking member (708). Thereby, pushing the second locking member (708) laterally in the first direction (102). The first support member (112) may traverse longitudinally in the fourth direction (108) passing beyond the lock (2).

The at least two springs (6) may be configured to push the lock (2) in the opposite direction i.e., the second direction (104). Further, due to the pushing force by the at least two springs (6), when the first support member (112) passes beyond the second locking member (708) longitudinally, the second locking member (708) may traverse in the second direction (104) and may traverse into the space (124) between the first supporting member (112) and the second supporting member (114). The second locking member (708) may rest on the first supporting member (112).

In the same embodiment, to transition from the middle position to the upper position, when the user pulls the dishwasher rack towards the third direction (106), at least a portion of at least one surface of the second support member (114) may interface with at least a portion of the second angled surface (714) of the second locking member (708). Thereby, pushing the second locking member (708) laterally in the first direction (102). The second support member (114) may traverse longitudinally in the fourth direction (108) passing beyond the lock (2).

The at least two springs (6) may be configured to push the lock (2) in the opposite direction i.e., the second direction (104). Further, due to the pushing force by the at least two springs (6), when the second support member (114) passes beyond the second locking member (708) longitudinally, the second locking member (708) may traverse in the second direction (104) and may traverse into the space (124) between the second support member (114) and the third supporting member (116). The second locking member (708) may rest on the second supporting member (114).

The processes described above is described as a sequence of steps, this was done solely for the sake of illustration. Accordingly, it is contemplated that some steps may be added, some steps may be omitted, the order of the steps may be re-arranged, or some steps may be performed simultaneously.

Although embodiments have been described with reference to specific example embodiments, it will be evident that various modifications and changes may be made to these embodiments without departing from the broader spirit and scope of the system and process or method described herein. Accordingly, the specification and drawings are to be regarded in an illustrative rather than a restrictive sense.

Many alterations and modifications of the present invention will no doubt become apparent to a person of ordinary skill in the art after having read the foregoing description. It is to be understood that the phraseology or terminology employed herein is for the purpose of description and not of limitation. It is to be understood that the description above contains many specifications, these should not be construed as limiting the scope of the invention but as merely providing illustrations of some of the personally preferred embodiments of this invention.

What is claimed is:

1. A start-stop rack adjustment mechanism for a dishwasher rack comprising:

a mechanism main body, wherein the mechanism main body defines:

a first longitudinal slot;

at least one second longitudinal slot; and a first lateral slot;

a latch disposed on the mechanism main body, wherein the latch is configured to be received within the first longitudinal slot;

a lock received by the first lateral slot, wherein the lock is configured to move laterally in a first direction and a second direction within the first lateral slot when the latch interfaces with at least a portion of the lock, wherein the lock is configured to move only in one of the directions from the first direction and the second direction at a time, wherein the lock comprises:

at least two springs, wherein:

the at least two springs are disposed below the lock; and at least portion of the springs are received by the mechanism main body; and a rack main body disposed on a side wall of a dishwasher, wherein, at least a portion of the rack main body is configured to be received by the at least one second longitudinal slot;

the latch is disposed between the mechanism main body and the rack main body; and the lock is configured to move perpendicular to movement of the mechanism main body.

2. The start-stop rack adjustment mechanism according to claim 1, wherein the mechanism main body is configured to longitudinally transition between an upper position, a middle position, and a lower position.

3. The start-stop rack adjustment mechanism according to claim 2, wherein, the rack main body comprises of plurality of support members, wherein the plurality of support members are protrusions, wherein a space is defined between each of the support members and the adjacent support member, wherein the space between the plurality of support members is configured to receive at least a portion of the lock and also enable lateral movement of the lock;

the plurality of support members are longitudinally aligned;

at least a portion of the plurality of support members are received by the second longitudinal slot; and the plurality of support members are configured to traverse longitudinally within the second longitudinal slot.

4. The start-stop rack adjustment mechanism according to claim 3, wherein the plurality of support members comprises a first support member, a second support member and a third support member, wherein the second support member is disposed between the first support member and the third support member.

5. The start-stop rack adjustment mechanism according to claim 4, wherein, in the upper position the lock is positioned between the first support member and the second support member;

in the middle position the lock is positioned between the second support member and the third support member; and in the lower position the lock is positioned below the third support member.

6. The start-stop rack adjustment mechanism according to claim 4, wherein, the lock comprises a first locking member, a second locking member and a third locking member, wherein each of the locking members and the adjacent locking member define a space;

the second locking member is disposed between the first locking member and the third locking member;

springs are connected to the first locking member and the third locking member respectively; and the locking members protrude from the lock towards the rack main body.

7. The start-stop rack adjustment mechanism according to claim 6, wherein, the first locking member comprises of a first angled surface;

the second locking member comprises of a second angled surface; and the first angled surface of the first locking member is opposite to the second angled surface of the second locking member.

8. The start-stop rack adjustment mechanism according to claim 7, wherein, the latch comprises a third angled surface;

the first angled surface of the first locking member is parallel to the third angled surface of the latch; and when the latch is moved longitudinally in a third direction, the first angled surface of the first locking member is configured to interface with the third angled surface of the latch, wherein the lock is configured to move laterally in the first direction when the first angled surface of the first locking member interfaces with the third angled surface of the latch.

9. The start-stop rack adjustment mechanism according to claim 8, wherein when at least one support member is moved longitudinally in a fourth direction, at least a portion of at least one surface of the support member interfaces with at least a portion of the second angled surface of the second locking member, wherein the lock is configured to move laterally in the first direction enabling the at least one support member to pass through space defined between the second locking member and the third locking member.

10. The start-stop rack adjustment mechanism according to claim 1, wherein, the mechanism main body defines a third longitudinal slot, wherein at least one first lateral protrusion is provided towards opening of the third longitudinal slot, wherein the first lateral protrusion overlaps at least a portion of the third longitudinal slot;

the rack main body comprises of a first guiding member provided with a second lateral protrusion, wherein the second lateral protrusion is configured to interface with the first lateral protrusion when the first guiding member is received within the third longitudinal slot; and the first guiding member is configured to traverse longitudinally within the third longitudinal slot.

11. The start-stop rack adjustment mechanism according to claim 1, wherein, the first longitudinal slot is provided with at least a pair of first lateral protruding members provided towards opening of the first longitudinal slot;

the pair of first lateral protruding members overlap at least a portion of the first longitudinal slot; and the pair of first lateral protruding members limit movement of the latch to longitudinal direction when the latch is received by the first longitudinal slot.

12. The start-stop rack adjustment mechanism according to claim 1, wherein, the mechanism main body defines a pair of V-shaped spaces disposed below the first lateral slot;

at least a portion of the springs are received by the pair of V-shaped spaces when the lock is received by the first lateral slot; and each of the pair of V-shaped spaces is configured to allow lateral movement of the springs thereby enabling lateral movement of the lock within the first lateral slot.

13. The start-stop rack adjustment mechanism as claimed in claim 1, wherein the at least two springs are made of a plastic material.

* * * * *